United States Patent [19]

Beckmann et al.

[11] 4,099,908

[45] Jul. 11, 1978

[54] LOW PRESSURE GAS BURNER

[76] Inventors: Martin Josef Beckmann, 9719 - 75A St.; Ferris George Swann, 13903 - 47 Ave., both of Edmonton, Alberta, Canada

[21] Appl. No.: 714,093

[22] Filed: Aug. 13, 1976

[51] Int. Cl.[2] ..... F23Q 9/00

[52] U.S. Cl. ..... 431/284; 239/505; 239/424; 239/DIG. 7; 431/202

[58] Field of Search ..... 431/284, 202, 4, 5; 239/505, 506, 424, 571, DIG. 7

[56] References Cited

U.S. PATENT DOCUMENTS

| | | | |
|---|---|---|---|
| 3,709,654 | 1/1973 | Desty et al. | 431/284 |
| 3,833,337 | 9/1974 | Desty et al. | 431/284 |
| 3,915,622 | 10/1975 | Desty et al. | 431/284 |
| 3,947,216 | 3/1976 | Teodorescu et al. | 431/284 X |

*Primary Examiner*—Edward G. Favors
*Attorney, Agent, or Firm*—E. P. Johnson

[57] ABSTRACT

The burner comprises inner and outer tubular concentrically arranged conduits having their outlets positioned approximately in the same plane. The inner conduit is connected to a high pressure gas source; the outer conduit is connected to a low pressure gas source. The end face of the inner conduit forms a valve seat in which a Coanda-type valve body seats. The valve body is axially displaceable away from the valve seat so as to co-operate therewith to form an annular passage. A tubular shroud concentrically surrounds the conduit outlets and valve body in spaced relation therewith. In operation, high pressure gas unseats the valve body and flows at high velocity through the annular passage. This gas flow follows the surface of the valve body in the form of an attached jet and creates a low pressure zone adjacent said valve body surface, with the result that low pressure gas is sucked or drawn out of the outer conduit and simultaneously air is drafted into the annulus formed between the shroud and the valve body. The three streams mix in the annulus to form a combustible mixture. The burner is advantageous in that it provides improved suction and mixing, thereby using a relatively low amount of high pressure gas in its operation.

3 Claims, 1 Drawing Figure

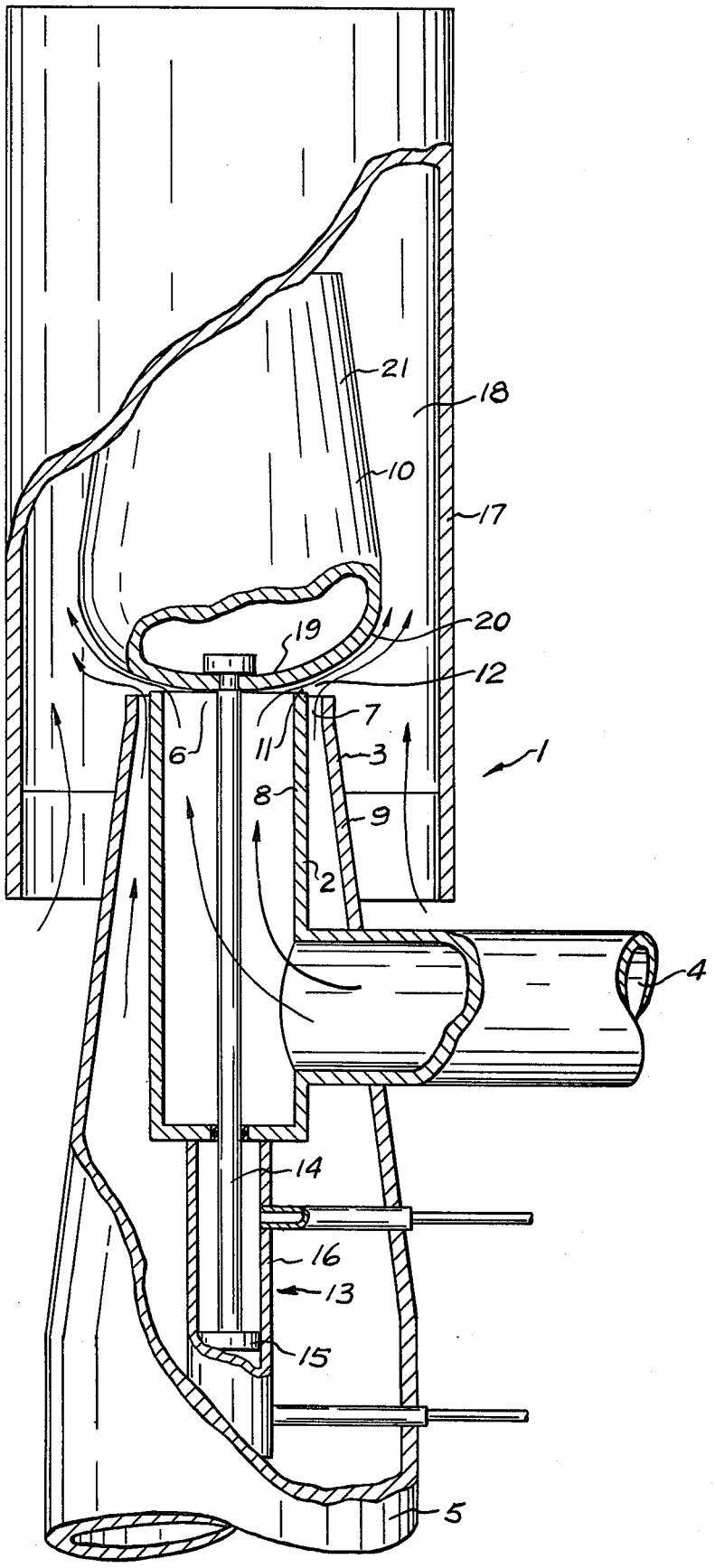
21
18
10
17
19
20
12
7
11
3
1
6
8
9
2
4
14
16
13
15
5

LOW PRESSURE GAS BURNER

BACKGROUND OF THE INVENTION

This invention relates to a burner adapted to be used on gas flare stacks and the like.

The burner has particular application in cases where low pressure gas flows are to be flared, as from stock tank gas vents. In this type of situation, it is usually necessary to provide some means for drawing the low pressure gas from its source into the combustion zone at a reasonable rate and for mixing it with air to provide a combustible mixture which will burn substantially smokelessly.

From U.S. Pat. No. 3,833,337, issued to D. H. Desty on Sept. 3, 1974, it is known to provide a flare stack burner having the following features:

(a) separate high and low pressure gas lines are provided;

(b) a valve body of the Coanda type is fixed to the end of the high pressure line and cooperates therewith to form a narrow annular outlet through which the high pressure gas flows;

(c) the outlet end of the high pressure line is in the form of a bellows so that the end face of the line moves axially relative to the stationary Coanda valve body to vary the width of the annular outlet and thereby maintain a constant backpressure within the feed line; and (d) the low pressure gas line extends through the Coanda valve body so that its outlet coincides with the end face of said body, which is immediately adjacent the combustion zone.

In operation, the high pressure gas flows out of its feed line outlet and follows the transverse and curved surface of the Coanda-type valve body which is positioned at said outlet. A low pressure zone is created by this gas flow adjacent the curved surface, with the result that air and low pressure gas are drawn into the high pressure gas flow and mix therewith to form a combustible mixture.

According to my investigations, this prior art burner uses about five parts of high pressure gas for each part of low pressure gas. It is the object of this invention to provide a burner which significantly reduces this ratio.

SUMMARY OF THE INVENTION

In accordance with the present invention a burner is provided having tubular outer and inner conduits. The outlet end of the inner conduit is positioned within the outlet end of the outer conduit, preferably concentrically, and the outlets of the two conduits are substantially even in elevation. The inner conduit's outlet end face forms a valve seat and a Coanda-type valve body is positioned at the end of the conduit and seats in said valve seat. The valve body is preferably free-floating or axially displaceable, so that the high pressure gas can unseat it to cause it to co-operate with the end of the inner conduit to form an annular passage of variable cross-sectional area; the high pressure gas then flows through this passage at a substantially constant velocity and follows the body's curved surface, thereby creating an adjacent low pressure zone, as previously described. Preferably, a tubular shroud is provided in concentric and spaced relationship about the valve body to improve the drawing in of air.

It has been discovered that positioning the low pressure gas outlet immediately adjacent the high pressure gas outlet at the base of the valve body results in greatly improved drawing and mixing of the low pressure gas, thereby insuring that the improved burner uses only about one part of high pressure gas to draw and mix five parts of low pressure gas and provide a combustible mixture. The explanation for this improvement appears to be that the high pressure gas flow velocity is greatest at the narrow annular passage, with the result that the suction condition is maximized at that point.

DESCRIPTION OF THE DRAWING

The FIGURE is a partly broken away side view showing the preferred form of the burner.

DESCRIPTION OF THE PREFERRED EMBODIMENT

The burner 1 comprises a tubular inner conduit 2 and tubular outer conduit 3, each having an outlet 6, 7 respectively. The inner conduit 2 is connectable to a high pressure gas line 4; the outer conduit 3 is connectable to a low pressure gas line 5. By way of example, the low pressure gas might be at 0.5 psi and the high pressure gas might be at 50 psi.

The outlet end 8 of the inner conduit 2 is positioned concentrically within the outlet end 9 of the outer conduit 3 and their respective outlets 6, 7 are disposed substantially in a common plane.

A valve body 10 of the Coanda type is positioned at the end of the inner conduit 2 and seats in a valve seat 11 formed by said conduit's end face.

The valve body 10 is "free floating" or axially displaceable away from the valve seat 11 — when displaced, it co-operates with the end 8 of the inner conduit 2 to form an annular passage 12 of variable cross-sectional area.

A damper assembly 13 is connected with the valve body 10 and functions to dampen its axial movement. This assembly comprises a shaft 14 attached at its upper end to the valve body 10 and carrying a block 15 at its lower end. The shaft 14 extends into a sealed, oil-filled pipe 16. The block 15 is spaced slightly from the inner surface of the pipe 16 to provide a clearance. The oil is slowly metered by the clearance when the valve body 10 and shaft 15 are moving up or down, and in this manner the axial movement is retarded or dampened.

As shown, the valve body 10 may be generally tulip shaped, having a base 13 which extends transversely across the inner conduit 6 and curves to assume a tapered configuration running in the direction of the main axis of the burner. This configuration is common in the art and is operative to deflect high pressure gas leaving through the annular passage 12 and cause it to adhere to it and form an attached jet in accordance with what is known as the attached jet or Coanda effect.

A tubular shroud 17 concentrically surrounds the conduit ends 8, 9 and the valve body 10 in spaced relation therewith to form an annulus 18.

In operation, the high pressure gas displaces the valve body 10 from the valve seat 11 and flows out through the annular passage 12 at a generally constant velocity. This gas follows the curved and tapered surfaces 20, 21 of the valve body 10 in the form of an attached jet. It creates a low pressure gas from the outlet 7 as well as air into the annulus 18 to mix with the high pressure gas flow and form a combustible mixture.

The invention is characterized by the following advantages:

(1) Because a free-floating valve body is used to provide a constant and high velocity flow of high pressure gas along the valve body surface and the low pressure gas outlet is located adjacent the base of the valve body, where the low pressure condition is at a high level, low pressure gas is rapidly drawn from the feed conduit with only a low consumption of high pressure gas;

(2) Because the air and the two gas flows mix along a path of substantial length as they move through the annulus 18, improved mixing is obtained with the result that smokeless burning can be achieved with a low consumption of high pressure gas; and (3) The burner is simple in construction and operation, thereby insuring low construction and maintenance cost.

The embodiments of the invention in which an exclusive property or privilege is claimed are defined as follows:

1. A burner for use in association with a relatively high pressure gas supply line and a relatively low pressure gas supply line, which comprises:

a tubular outer conduit for connection to the low pressure gas supply line and a tubular inner conduit for connection to the high pressure gas supply line, each conduit having an outlet end and an outlet;

the outlet end of said inner conduit being positioned within the outlet end of said outer conduit so that their outlets are substantially even in elevation;

said inner conduit forming a valve seat at its outlet;

a Coanda-type valve body having a curved surface, said valve body being positioned at the end of the inner conduit and arranged to seat in the valve seat and being axially displaceable from said seat whereby said valve body and valve seat co-operate to form an annular passage whereby high pressure gas flowing through said passage is deflected by and follows the curved surface of the valve body, thereby creating a low pressure zone adjacent said surface which functions to draw low pressure gas, from the outer conduit, and air into the high pressure gas flow so that they mix and form a combustible mixture.

2. The burner as set forth in claim 1 comprising:

a tubular shroud member surrounding the conduits and the valve body in substantially concentric spaced relationship, said shroud member extending longitudinally beyond the downstream end of the valve body.

3. The burner as set forth in claims 1 comprising:

means for dampening the axial displacement of the valve body.

* * * * *